United States Patent [19]

Riegler et al.

[11] 4,437,187

[45] Mar. 13, 1984

[54] ELECTRIC FURNACE ARRANGEMENT

[75] Inventors: Ernst Riegler, Enns; Ernst Zajicek, Ottensheim, both of Austria

[73] Assignee: Voest-Alpine Aktiengesellschaft, Linz, Austria

[21] Appl. No.: 423,223

[22] Filed: Sep. 24, 1982

[30] Foreign Application Priority Data

Oct. 9, 1981 [AT] Austria ..... 4348/81

[51] Int. Cl.[3] ..... F27D 1/18

[52] U.S. Cl. ..... 373/73; 254/DIG. 4; 432/250

[58] Field of Search ..... 373/98, 81, 79, 73; 254/DIG. 4; 432/156, 157, 160, 250; 414/147, 160, 179, 199; 110/173 A, 176

[56] References Cited

FOREIGN PATENT DOCUMENTS 287055 11/1970 U.S.S.R. ..... 373/73

*Primary Examiner*—Roy N. Envall, Jr.

*Attorney, Agent, or Firm*—Brumbaugh, Graves, Donohue & Raymond

[57] ABSTRACT

An electric furnace includes a lifting structure actuating a furnace cover and comprising a stationary supporting post. A lifting means is axially displaceably guided on the stationary supporting post by an upper and a lower bearing. The lifting column is liftable and lowerable by the lifting means and engageable with, and disengageable from, the furnace cover. In order to provide a lifting structure that enables either a lower construction height or substantially slighter forces in the bearings of the lifting column, the hollowly designed lifting column peripherally surrounds the stationary supporting post. The lifting means is articulately connected with a head plate closing the lifting column on its upper end and with a stationary part of the plant.

6 Claims, 4 Drawing Figures

ELECTRIC FURNACE ARRANGEMENT

BACKGROUND OF THE INVENTION

The invention relates to an electric furnace, such as an electric arc furnace or a plasma melting furnace, comprising a lifting structure actuating a furnace cover and including a stationary supporting post, a lifting means arranged within the stationary supporting post and a lifting column axially displaceably guided on the stationary supporting post by means of an upper and a lower bearing, which lifting column is liftable and lowerable by the lifting means and engageable with, and disengageable from, the furnace cover.

An electric furnace of this kind is known from U.S.S.R. Pat. No. 287,055. The lifting means in that electric furnace is arranged below the lifting column. Because the two bearings guiding the lifting column have to be as far remote from each other as possible for a perfect accommodation of the cover forces and the moments caused by these forces, a large construction height is necessary with that structure, due to the resulting great length of the lifting column and of the lifting means arranged below the same.

On account of the large construction height, that structure, in addition, is heavy and expensive, pivoting of the cover being effected in an unstable and resilient manner, respectively.

SUMMARY OF THE INVENTION

The invention aims at avoiding these disadvantages and difficulties, and has as its object to provide an electric furnace of the initially defined kind, which comprises a lifting structure that either enables a lower construction height as compared to the above-described lifting structure or, with the same construction height, enables substantially slighter forces in the bearings of the lifting column as compared to that lifting structure.

This object is achieved according to the invention in that the hollowly designed lifting column peripherally surrounds the stationary supporting post, and that the lifting means, preferably a double-acting hydraulic cylinder, on the one hand, is articulately connected with a head plate closing the lifting column on its upper end and, on the other hand, is articulately connected with a stationary part of the plant, such as the base or the stationary supporting post.

It has already been proposed (U.S. patent application Ser. No. 336,896 of 1981) to design, with a lifting means for the cover of an electric furnace in which the lifting column peripherally surrounds the stationary supporting post, the space between a head plate closing the lifting column on its upper end and the stationary supporting post as a cylinder space actuatable by a hydraulic medium and acting in the lifting direction.

This is of a particular advantage for smaller electric furnaces because of the simplicity of the design. With larger electric furnaces (from about 40 t liquid bath), i.e., with electric furnaces having very heavy covers, the lifting column will have a large inner diameter, which results in a relatively large cylinder space, calling for large amounts of oil for moving the lifting column and the cover. Because the cover lifting and lowering times shall not exceed certain measures, it is difficult to convey the necessary high amounts of oil into the cylinder space within the time available for lifting the cover. With the design according to the invention, this problem does not arise, since a hydraulic cylinder with a small cylinder space can be used.

BRIEF DESCRIPTION OF THE DRAWINGS

The invention will now be explained in more detail with reference to the accompanying drawings, wherein.

DESCRIPTION OF EXEMPLARY EMBODIMENT

Figure 1:
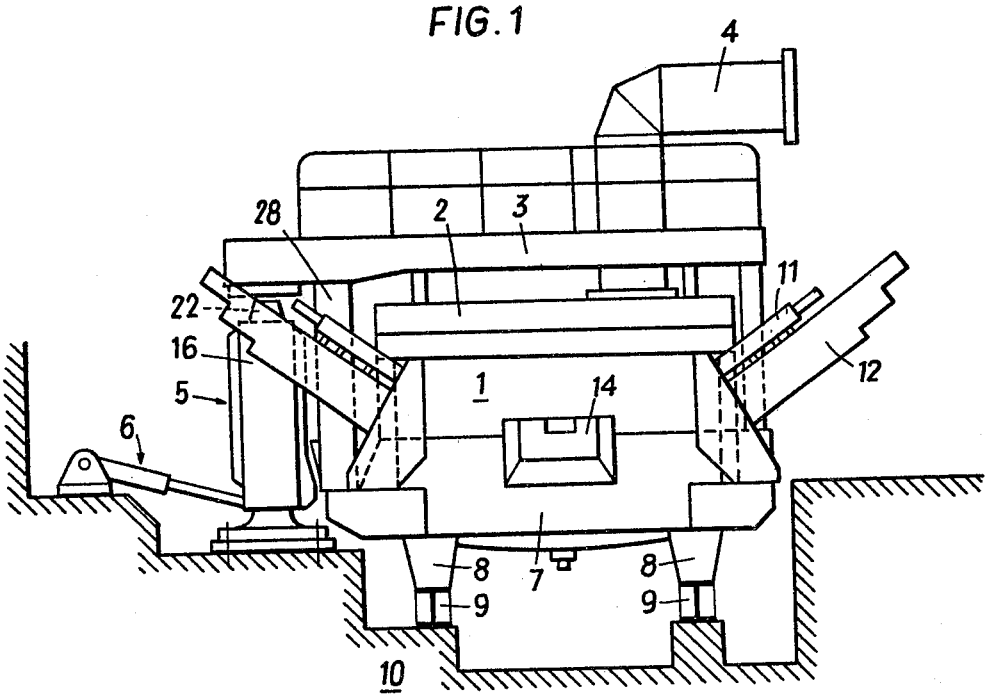
FIG. 1 is a plasma melting plant in side view.

A furnace upper part 1 of a plasma melting furnace, in particular a plasma primary melting furnace, is provided with a cover 2 carried by a cover carrying structure 3. From the cover a flue gas bend 4 projects to an exhaust (not illustrated). Laterally beside the furnace upper part 1, the cover lifting structure 5 and the cover pivoting structure 6 are arranged. The furnace lower part 7, via movable beams, rests on runways 9 supported on the base 10.

It can be seen from the ground plan that this is a very large furnace comprising four plasma burners 11. Each of the four plasma burners 11 is movably mounted on an oblique burner mechanism 12. The slag door is denoted by 13 and the pouring spout is denoted by 14.

Figure 2:
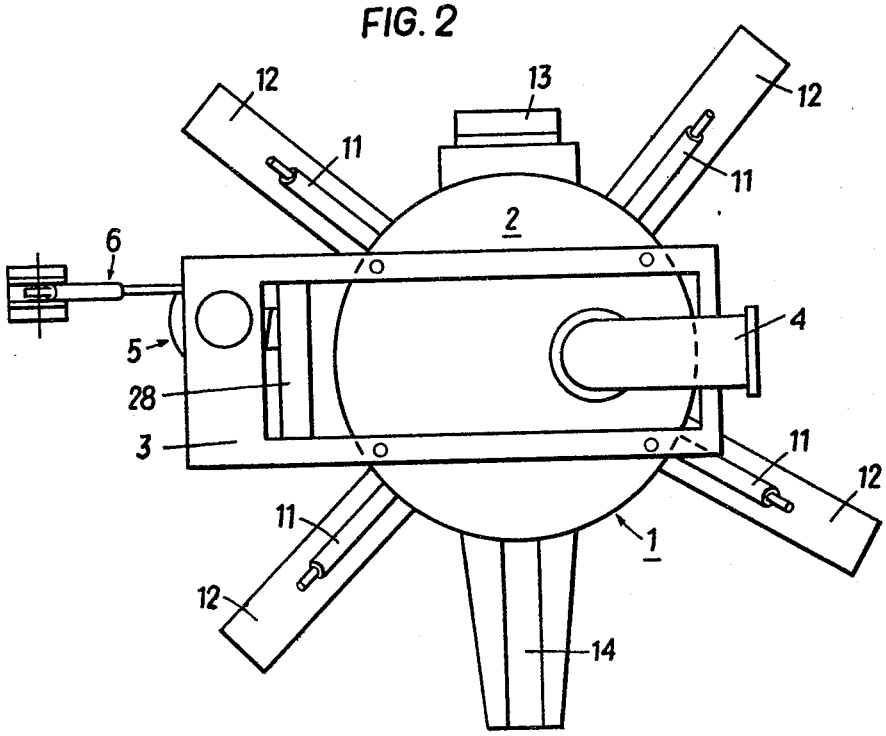
FIG. 2 is a plasma melting plant in ground plan.
Figure 4:
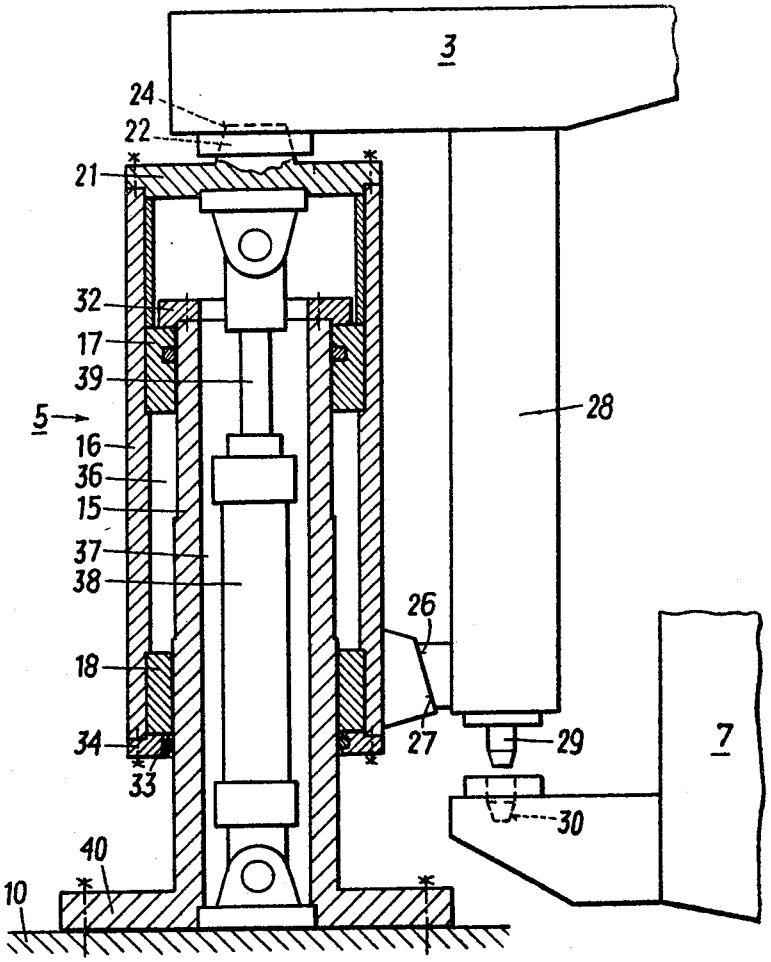
FIGS. 3 and 4 illustrate sections through the cover lifting means, once (FIG. 3) in the lowered position and once (FIG. 4) in the lifted position, of the cover.
Figure 3:
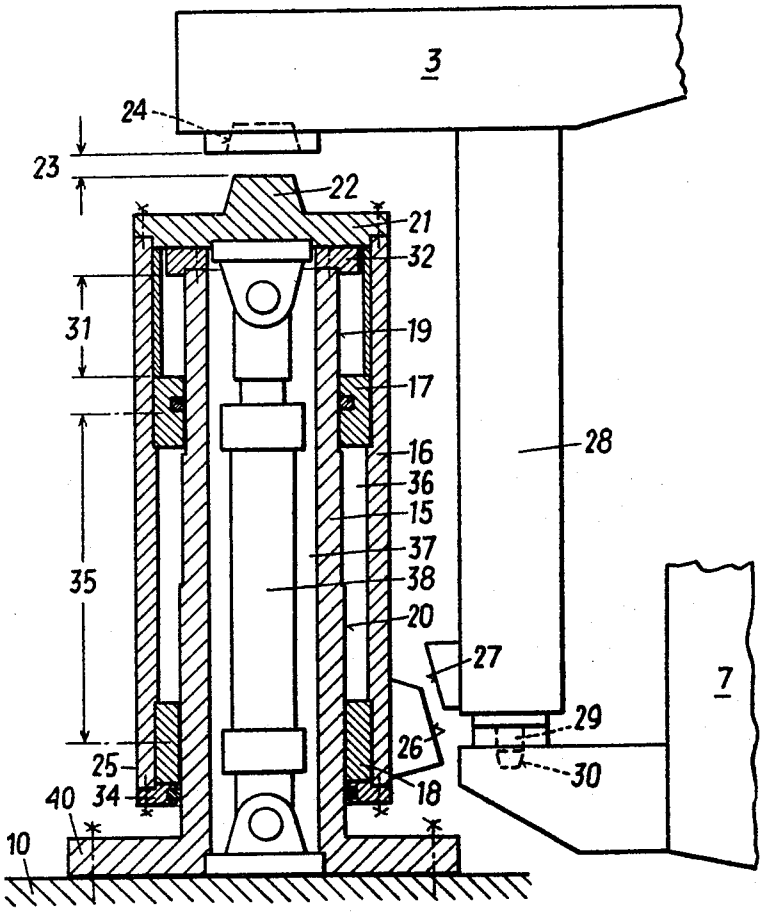

As seen more clearly in FIGS. 2 and 3, the cover lifting structure 5 comprises a hollow supporting post 15 rigidly connected, e.g., screwed, with the base 10, and arranged within a hollow sleeve-shaped lifting column 16. Between the lifting column 16 and the supporting post 15, bearings 17, 18 are provided, which are designed as bearing bushes, advantageously as slide bearing bushes of bronze, allowing for a lifting, lowering and pivoting of the lifting column 16 on the supporting post 15. The bearing bushes are fastened to the lifting column 16, sliding along slideways 19, 20 provided on the supporting post 15 during movement of the lifting column 16 relative to the stationary supporting post 15.

The lifting column 16, on its upper end, is closed by a head plate 21. This head plate, on its outer side, comprises a conical load bearing 22, which is below the cover carrying structure 3 at a distance 23, with the cover carrying structure 3 and the lifting column 16 lowered, so that, on the one hand, no oscillations of the cover carrying structure 3 will be transmitted to the cover lifting structure 5 during the melting procedure and, on the other hand, the furnace vessel 1, 7 can be tilted into the teeming or slagging position without impediment. With the carrying column 16 and thus the cover carrying structure 3 lifted, the load bearing 22 projects into a corresponding recess 24 of the cover carrying structure 3.

An inclined surface 26 provided near the lower end 25 of the lifting column 16 gets into engagement with a corresponding counter inclined surface 27 arranged on a vertical standard 28 of the cover carrying structure 3 during lifting. The vertical standard 28, which rests on the furnace lower part 7 with the cover carrying structure in the lowered position, projects into a corresponding recess 30 of the furnace lower part 7 by a pin 29 arranged on its lower end with the cover carrying structure 3 in the lowered position.

The upper one (17) of the bearing bushes 17, 18, with the lifting column 16 in the lowered position, is at a distance 31 below a radially outwardly projecting annular flange 32 of the supporting post 15, which distance corresponds to at least the lifting height of the lifting column 16. The lower bearing bush 18 is arranged on the lower end of the lifting column 16 and is held by a radially inwardly projecting annular flange 34 provided with a seal 33.

The annular space 36 present between the bearing bushes 17, 18 arranged at a distance 35 as large as possible is filled with lubricant, which is permanently available in this annular space. This has the advantage that a highly viscous oil can be used, which ensures a correspondingly high service life of the bearing bushes 17, 18. Suitably, the bearing bushes have slanted conical run-in and run-out surfaces (not illustrated) for the formation of a lubricating film.

In the cavity 37 of the supporting post 15 a hydraulic cylinder 38 is arranged, which is articulately connected with the base 10 via its lower end and with the head plate 21 via the upper end of the piston 39. The lower end also could be articulately connected with a flange 40 radially projecting from the stationary supporting post 15, if the flange were inwardly elongated.

The hydraulic cylinder 39 is double-acting so that the lifting column can be lowered with the help of the hydraulic cylinder until the conical load bearing 22 is disengaged from the corresponding recess 24 of the cover carrying means 3.

The arrangement of the bearing bushes 17, 18 at a distance 35 as large as possible and as close as possible near the ends of the stationary supporting post results in a slight construction height of the supporting post, with a bearing load that is still justifiable, and thus a relatively low weight and a high rigidity of the structure. Furthermore, it is possible, in case of a predetermined construction height, to move the bearing bushes 17, 18 extensively asunder by making use of the construction height, so that the forces occurring on the bearing bushes 17, 18 and caused by the cover 2 and the cover carrying structure 3 can be kept low.

The hydraulic cylinder may be replaced by any other lifting means, for instance, by a threaded spindle, a toothed rack, etc., yet an hydraulic cylinder is of a particular advantage on account of the limited space conditions in the interior of the supporting post 15 with respect to mounting and repair work.

What we claim is:

1. In an electric furnace arrangement, such as an electric arc furnace, a plasma melting furnace and the like, and of the type including a furnace cover, a furnace cover carrying structure, and a lifting structure for raising and lowering said furnace cover relative to said furnace, said lifting structure comprising a stationary supporting post, a lifting means arranged within said stationary supporting post, a lifting column engageable with and disengageable from said furance cover carrying structure, said lifting column being vertically displaceable by operation of said lifting means, and an upper bearing means and a lower bearing means for guiding said lifting column on said stationary supporting post, the improvement wherein said lifting column is hollow and said stationary supporting post is arranged within and peripherally surrounded by said lifting column, whereby said lifting column and said stationary supporting post are telescopingly displaceable relative to each other by operation of said lifting means, the improvement further comprising a head plate closing said lifting column on an upper end thereof, an upper end of said lifting means being articulately connected with said head plate and a lower end of said lifting means being articulately connected with one of a base supporting said furance arrangement and a lower end of said stationary support post.

2. An electric furnace arrangement as set forth in claim 5, wherein said lifting means comprises a double-acting hydraulic cylinder.

3. An electric furnace arrangement as set forth in claim 1, wherein said lower end of said lifting means is articulately connected to said base.

4. An electric furnace arrangement as set forth in claim 1, wherein said lower end of said lifting means is articulately connected to said stationary supporting post.

5. An electric furnace arrangement as set forth in claim 1, wherein said stationary supporting post comprises a radially outwardly projecting annular flange at its upper end which cooperates with said upper bearing to limit the vertical displacement of said lifting column.

6. An electric furnace arrangement as set forth in claim 1, wherein said lifting column rests on said stationary supporting post in a fully lowered position.

* * * * *

UNITED STATES PATENT AND TRADEMARK OFFICE

CERTIFICATE OF CORRECTION

PATENT NO. : 4,437,187

DATED : Mar. 13, 1984

INVENTOR(S) : Riegler et al.

It is certified that error appears in the above—identified patent and that said Letters Patent is hereby corrected as shown below:

First page, Item 56, following "FOREIGN PATENT DOCUMENTS" insert:

| | | |
|---|---|---|
| --1,290,741 | 3/1962 | France |
| 1 170 090 | 5/1964 | Federal Republic of Germany |
| 1 508 471 | 1/1970 | Federal Republic of Germany (OS) |
| 2 033 863 | 5/1980 | United Kingdom--. |

Col. 2, line 11, "lifted" should read --raised--.

Col. 4, line 29, "furance" should read --furnace--; and
line 32, "claim 5" should read --claim 1--.

Signed and Sealed this

Thirtieth Day of October 1984

[SEAL]

Attest:

GERALD J. MOSSINGHOFF

Attesting Officer

Commissioner of Patents and Trademarks